US006012026A

United States Patent [19]

Taori et al.

[11] Patent Number: 6,012,026

[45] Date of Patent: Jan. 4, 2000

[54] VARIABLE BITRATE SPEECH TRANSMISSION SYSTEM

[75] Inventors: Rakesh Taori; Andreas J. Gerrits, both of Eindhoven, Netherlands

[73] Assignee: U.S. Philips Corporation, New York, N.Y.

[21] Appl. No.: 09/052,293

[22] Filed: Mar. 31, 1998

[30] Foreign Application Priority Data

Apr. 7, 1997 [EP] European Pat. Off. ..... 97200998

[51] Int. Cl.[7] ..... G10L 9/14

[52] U.S. Cl. ..... 704/229; 704/207; 704/209; 704/214; 704/219

[58] Field of Search ..... 704/229, 219, 704/214, 208, 207, 209

[56] References Cited

U.S. PATENT DOCUMENTS

| | | | |
|---|---|---|---|
| 4,379,949 | 4/1983 | Chen et al. | 179/15.55 R |
| 5,414,796 | 5/1995 | Jacobs et al. | 395/2.3 |
| 5,651,091 | 7/1997 | Chen | 704/223 |
| 5,745,871 | 4/1998 | Chen | 704/207 |
| 5,777,992 | 7/1998 | Lokoff | 370/389 |
| 5,878,387 | 3/1999 | Oshikiri et al. | 704/207 |

FOREIGN PATENT DOCUMENTS

| | | | |
|---|---|---|---|
| 0665693A2 | 2/1995 | European Pat. Off. | H04N 7/56 |

*Primary Examiner*—David R. Hudspeth
*Assistant Examiner*—Susan Wieland

[57] ABSTRACT

A transmission system with a transmitter and a receiver. The transmitter has a speech encoder with analysis means, has calculation means, and has control means. The receiver has a speech decoder. Through a transmission medium, the transmitter transmits frames of data to the receiver. The analysis means determine analysis coefficients from a speech signal. From a bitrate setting, the calculation means calculate a fraction of the frames of data to carry more information about the analysis coefficients than a remaining number of the frames of data. The control means control the transmitter to transmit the fraction of the frames of data and to transmit the remaining number of the frames of data. The receiver receives the frames of data. The receiver derives a reconstructed speech signal from the received frames of data.

10 Claims, 5 Drawing Sheets

VARIABLE BITRATE SPEECH TRANSMISSION SYSTEM

BACKGROUND OF THE INVENTION

1. Field of the Invention

The present invention is related to a transmission system comprising a transmitter with a speech encoder. More particularly speech encoder comprises analysis means for determining analysis coefficients from an input speech signal, the transmitter transmits frames of data representing the speech signal via a transmission medium to a receiver, a fraction of the frames carries more information about said analysis coefficients than the remaining frames, and the receiver comprises a speech decoder for deriving a reconstructed speech signal from the frames of data representing the speech signal.

The present invention is also related to a transmitter, a speech encoder and a speech coding method.

2. Description of the Related Art

A transmission system is known from U.S. Pat. No. 4,379,949.

Such transmission systems are used in applications in which speech signals have to be transmitted over a transmission medium with a limited transmission capacity, or have to be stored on storage media with a limited storage capacity. Examples of such applications are the transmission of speech signals over the Internet, transmission of speech signals from a mobile phone to a base station and vice versa and storage of speech signals on a CD-ROM, in a solid state memory or on a hard disk drive.

In a speech encoder the speech signal is analyzed by analysis means which determines a plurality of analysis coefficients for a block of speech samples, also known as a frame. A group of these analysis coefficients describes the short time spectrum of the speech signal. An other example of an analysis coefficient is a coefficient representing the pitch of a speech signal. The analysis coefficients are transmitted via the transmission medium to the receiver where these analysis coefficients are used as coefficients for a synthesis filter.

Besides the analysis parameters, the speech encoder also determines a number of excitation sequences (e.g. 4) per frame of speech samples. The interval of time covered by such excitation sequence is called a sub-frame. The speech encoder is arranged for finding the excitation signal resulting in the best speech quality when the synthesis filter, using the above mentioned analysis coefficients, is excited with said excitation sequences. A representation of said excitation sequences is transmitted via the transmission channel to the receiver. In the receiver, the excitation sequences are recovered from the received signal and applied to an input of the synthesis filter. At the output of the synthesis filter a synthetic speech signal is available.

The bitrate required to describe a speech signal with a certain quality depends on the speech content. In case the analysis coefficients are substantially constant over a prolonged period of time, the bitrate required to transmit them could be reduced. This possibility is used in the transmission system according to the above mentioned U.S. patent. This patent describes a transmission system with a speech encoder in which the analysis coefficients are not transmitted every frame. They are only transmitted if the difference between at least one of the actual analysis coefficients in a frame and a corresponding analysis coefficient obtained by interpolation of the analysis coefficients from neighboring frames exceeds a predetermined threshold value. This results in a reduction of the bitrate required for transmitting the speech signal. In the known transmission system the bitrate can be set to arbitrary values by increasing or decreasing the threshold value, resulting in a decrease or increase of the bitrate. However the average bitrate still strongly depends on the speech content.

SUMMARY OF THE INVENTION

An object of the present invention is to provide a transmission system in which the bitrate can be set to arbitrary values, which is substantially independent of the speech content.

The speech encoder in the transmission system according to the invention comprises control means for controlling according to a bitrate setting, the fraction of frames carrying more information about said analysis coefficients than the remaining frames. By specifying a bit rate setting and controlling the actual fraction of the frames carrying information about the analysis coefficients in response to said bitrate setting, it is possible to obtain an average bitrate substantially independent from the speech content. It is even possible to change the average bitrate during run-time by changing the bitrate setting.

The actual fraction can be controlled in different ways. A first way is to use a modulo-M counter which is increased with steps N for each frame. Each time the counter overflows, the analysis coefficients are included in the frame. Consequently the fraction of frames carrying analysis coefficients is N/M.

In an embodiment of the invention is the control means comprises comparing means for comparing a measure for an actual bitrate with a measure for the bitrate setting, the control means being arranged for increasing the actual fraction of the frames carrying more information about said analysis coefficients than the remaining frames if the measure for the actual bitrate is smaller than the measure for the bitrate setting, and for decreasing the actual fraction of the frames carrying more information about said analysis coefficients than the remaining frames, if the measure for the actual bitrate is larger than the measure for the bitrate setting. According to this embodiment it is always ensured that the average bitrate of the coded speech signal is substantially equal to the bitrate setting.

In a further embodiment of the invention is the control means comprise are arranged for indicating the analysis parameters having a distance measure from values interpolated from analysis parameters transmitted in surrounding frames exceeding a threshold value, the control means being arranged for decreasing the threshold if the measure for the actual bitrate is smaller than the measure for the bitrate setting, and for increasing the threshold if the actual measure for the bitrate is larger than the measure for the bitrate setting. In this embodiment the analysis parameters differing the most from the interpolated values are transmitted. By increasing the threshold value if the actual bitrate is larger than the bitrate setting, and decreasing the threshold value otherwise, it is obtained that the average bitrate is substantially equal to the bitrate setting.

A further embodiment of the invention is characterized in that the fraction of the frames carrying more information about said analysis coefficients than the remaining frames is larger or equal to 0.5 and is smaller or equal to 1. Experiments have shown that reference fractions between 0.5 and 1 result in a sufficient control range without a substantial loss in coding quality.

In a further embodiment of the invention the speech encoder is arranged for selecting in response to a coarse bitrate setting, one frame length out of a plurality of frame lengths and one number of excitation sub-frames per frame out of a plurality of excitation sub-frames per frame. By selecting the frame length and the number of sub-frames out of a plurality of possible values in response to the bitrate setting, it is possible to obtain a continuous variable bitrate with a substantially increased range of the bitrate.

In a further embodiment of the invention the plurality of numbers of excitation sub-frames for a frame length of 10 ms comprises at least the value 4, and in that the plurality of number of excitation sub-frames for a frame length of 15 ms comprises at least the values 6, 8 and 10. Using the above mentioned parameters, it becomes possible to obtain a speech encoder which has a continuous variable bitrate that can be varied from 13.6 kbit/s to 21.8 kbit/s.

BRIEF DESCRIPTION OF THE DRAWINGS

The invention will now be explained with reference to the drawing figures. Herein shows.

DESCRIPTION OF THE PREFERRED EMBODIMENTS

Figure 1:
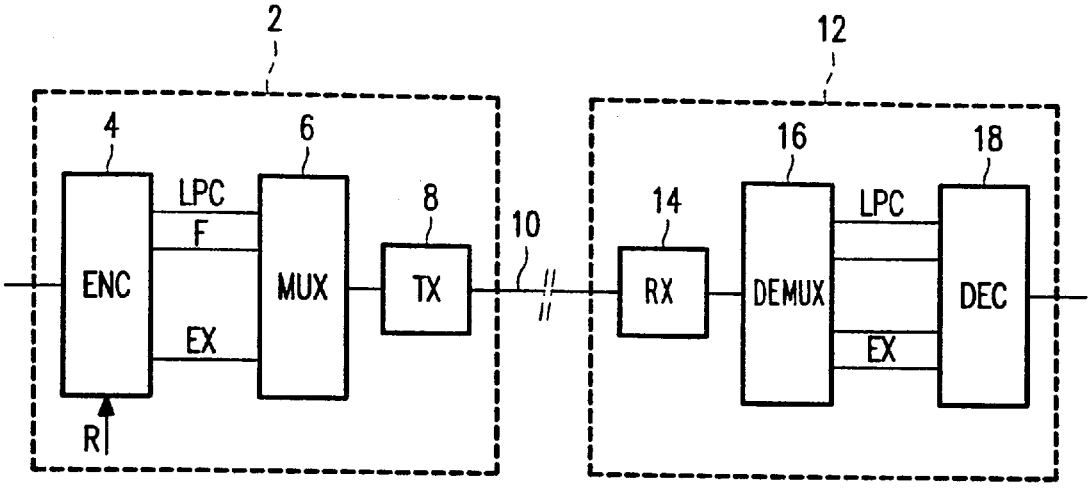
FIG. 1, a transmission system in which the invention can be used.

In the transmission system according to FIG. 1, the speech signal to be encoded is applied to an input of an speech encoder 4 in a transmitter 2. A first output of the speech encoder 2, carrying an output signal LPC representing the analysis coefficients, is connected to a first input of a multiplexer 6. A second output of the speech encoder 4, carrying an output signal F, is connected to a second input of a multiplexer 6. The signal F represents a flag indicating whether the signal LPC has to be transmitted or not. A third output of the speech encoder 4, carrying a signal EX, is connected to a third input of the multiplexer 6. The signal EX represents an excitation signal for the synthesis filter in a speech decoder. A bitrate control signal R is applied to a second input of the speech encoder 4.

An output of the multiplexer 6 is connected to an input of transmit means 8. An output of the transmit means 8 is connected to a receiver 12 via a transmission medium 10.

In the receiver 12, the output of the transmission medium 10 is connected to an input of receive means 14. An output of the receive means 14 is connected to an input of a demultiplexer 16. A first output of the demultiplexer 16, carrying the signal LPC, is connected to a first input of speech decoding means 18 and a second output of the demultiplexer 16, carrying the signal EX is connected to a second input of the speech decoding means 18. At the output of the speech decoding means 18 the reconstructed speech signal is available. The combination of the demultiplexer 16 and the speech decoding means 18 constitute the speech decoder according to the present inventive concept.

The operation of the transmission system according to the invention is explained under the assumption that a speech encoder of the CELP type is used, but it is observed that the scope of the present invention is not limited thereto.

The speech encoder 4 is arranged to derive an encoded speech signal from frames of samples of a speech signal. The speech encoder derives analysis coefficients representing e.g. the short term spectrum of the speech signal from the frames of samples of speech signals. In general LPC coefficients, or a transformed representation thereof, are used. Useful representations are Log Area Ratios (LARs), arcsines of reflection coefficients or Line Spectral Frequencies (LSFs) also called Line Spectral Pairs (LSPs). The representation of the analysis coefficients is available as the signal LPC at the first output of the speech encoder 4.

In the speech encoder 4 the excitation signal is equal to a sum of weighted output signals of one or more fixed codebooks and an adaptive codebook. The output signals of the fixed codebook is indicated by a fixed codebook index, and the weighting factor for the fixed codebook is indicated by a fixed codebook gain. The output signals of the adaptive codebook is indicated by an adaptive codebook index, and the weighting factor for the adaptive codebook is indicated by an adaptive codebook gain.

The codebook indices and gains are determined by an analysis by synthesis method, i.e. the codebook indices and gains are determined such that a difference measure between the original speech signal and a speech signal synthesized on basis of the excitation coefficients and the analysis coefficients, has a minimum value. The signal F indicates whether the analysis parameters corresponding to the current frame of speech signal samples are transmitted or not. These coefficients can be transmitted in the current data frame or in an earlier data frame.

The multiplexer 6 assembles data frames with a header and the data representing the speech signal. The header comprises a first indicator (the flag F) indicating whether the current data frame is an incomplete data frame or not. The header optionally comprises a second indicator which indicates whether the current data frame carries analysis parameters. The frame further comprises the excitation parameters for a plurality of sub-frames. The number of sub-frames is dependent on the bitrate chosen by the signal R at the control input of the speech encoder 4. The number of sub-frames per frame and the frame length can also be encoded in the header of the frame, but it is also possible that the number of sub-frames per frame and the frame length are agreed upon during connection setup. At the output of the multiplexer 6, the completed frames representing the speech signal are available.

In the transmit means 8, the frames at the output of the multiplexer 6 are transformed into a signal that can be transmitted via the transmission medium 10. The operations performed in the transmit means involve error correction coding, interleaving and modulation.

The receiver 12 is arranged to receive the signal transmitted by the transmitter 2 from the transmission medium 10. The receive means 14 are arranged for demodulation, deinterleaving and error correcting decoding. The demultiplexer extracts the signals LPC, F and EX from the output signal of the receive means 14. If necessary the demultiplexer 16 performs an interpolation between two sets of subsequently received sets of coefficients. The completed sets of coefficients LPC and EX are provided to the speech decoding means 18. At the output of the speech decoding means 18, the reconstructed speech signal is available.

Figure 2:
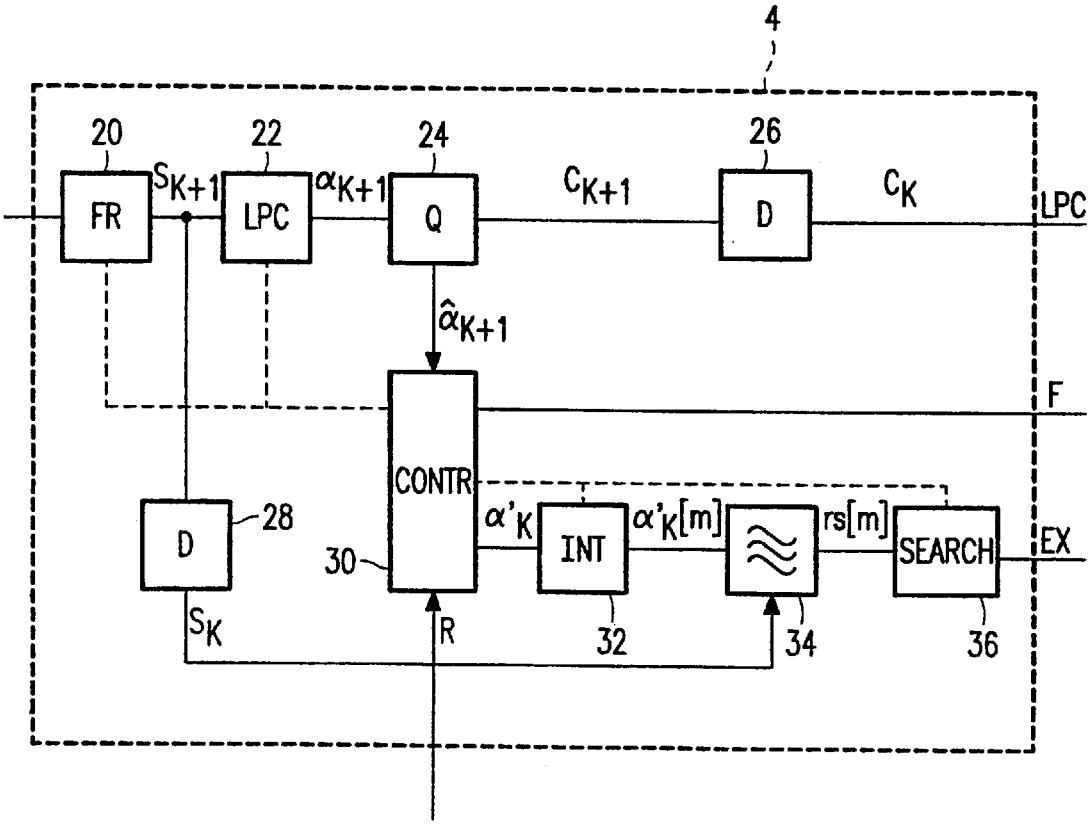
FIG. 2, an embodiment of the speech encoder 4 according to the invention.

In the speech encoder according to FIG. 2, the input signal is applied to an input of framing means 20. An output of the framing means 20, carrying an output signal $S_{k+1}$, is connected to an input of the analysis means, being here a linear predictive analyzer 22, and to an input of a delay element 28. The output of the linear predictive analyzer 22, carrying a signal $\alpha_{k+1}$, is connected to an input of a quantizer 24. A first output of the quantizer 24, carrying an output signal $C_{k-1}$, is connected to an input of a delay element 26, and to a first output of the speech encoder 6. An output of the delay element 26, carrying an output signal $C_k$, is connected to a second output of the speech encoder.

A second output of the quantizer 24 carrying a signal $\hat{\alpha}_{k+1}$, is connected to an input of the control means 30. An input signal R, representing a bitrate setting, is applied to a second input of the control means 30. A first output of the control means 30, carrying an output signal F, is connected to an output of the speech encoder 4.

A third output of the control means 30, carrying an output signal $\alpha'_k$ is connected to an interpolator 32. An output of the interpolator 32, carrying an output signal $\alpha'_k[m]$, is connected to a control input of a perceptual weighting filter 34. The output of the framing means 20 is also connected to an input of a delay element 28. An output of the delay element 28, carrying a signal $S_k$, is connected to a second input of the perceptual weighting filter 34. The output of the perceptual weighting filter 34, carrying a signal rs[m], is connected to an input of excitation search means 36. At the output of the excitation search means 36 a representation of the excitation signal EX comprising the fixed codebook index, the fixed codebook gain, the adaptive codebook index and the adaptive codebook gain are available at the output of the excitation search means 36.

The framing means derives from the input signal of the speech encoder 4, frames comprising a plurality of input samples. The number of samples within a frame can be changed according to the bitrate setting R. The linear predictive analyzer 22 derives a plurality of analysis coefficients comprising prediction coefficients $\alpha_{k+1}[p]$, from the frames of input samples. These prediction coefficients can be found by the well known Levinson-Durbin algorithm. The quantizer 24 transforms the coefficients $C_{k+1}[p]$ into another representation, and quantizes the transformed prediction coefficients into quantized coefficients $C_{k+1}[p]$, which are passed to the output via the delay element 26 as coefficients $C_k[p]$. The purpose of the delay element is to ensure that the coefficients $C_k[p]$ and the excitation signal EX corresponding to the same frame of speech input samples are presented simultaneously to the multiplexer 6. The quantizer 24 provides a signal $\hat{\alpha}_{k+1}$ to the control means 30. The signal $\alpha_{k+1}$ is obtained by a inverse transform of the quantized coefficients $C_{k+1}$. This inverse transform is the same as is performed in the speech decoder in the receiver. The inverse transform of the quantized coefficients is performed in the speech encoder, in order to provide the speech encoder for the local synthesis with exactly the same coefficients as are available to a decoder in the receiver.

The control means 30 are arranged to derive the fraction of the frames in which more information about the analysis coefficients is transmitted than in the other frames. In the speech encoder 4 according to the present embodiment the frames carry the complete information about the analysis coefficients or they carry no information about the analysis coefficients at all. The control unit 30 provides an output signal F indicating whether or not the multiplexer 6 has to introduce the signal LPC in the current frame. It is however observed that it is possible that the number of analysis parameters carried by each frame can vary.

The control unit 30 provides prediction coefficients $\alpha'_k$ to the interpolator 32. The values of $\alpha'_k$ are equal to the most recently determined (quantized) prediction coefficients if said LPC coefficients for the current frame are transmitted. If the LPC coefficients for the current frame are not transmitted, the value of $\alpha'_k$ is found by interpolating the values of $\alpha'_{k-1}$ and $\alpha'_{k+1}$.

The interpolator 32 provides linearly interpolated values $\alpha'_k[m]$ from $\alpha'_{k-1}$ and $\alpha'_k$ for each of the sub-frames in the present frame. The values of $\alpha'_k[m]$ are applied to the perceptual weighting filter 34 for deriving a "residual signal" rs[m] from the current sub-frame m of the input signal $S_k$. The search means 36 are arranged for finding the fixed codebook index, the fixed codebook gain, the adaptive codebook index and the adaptive codebook gain resulting in an excitation signal that give the best match with the current sub-frame m of the "residual signal" rs[m]. For each sub-frame m the excitation parameters fixed codebook index, fixed codebook gain, adaptive codebook index and adaptive codebook gain are available at the output EX of the speech encoder 4.

An example speech encoder according to FIG. 2, is a wide band speech encoder for encoding speech signals with a bandwidth of 7 kHz with a bitrate varying from 13.6 k-bit/s to 24 kbit/s. The speech encoder can be set at four so-called anchor bit rates, such anchor bit rates being coarse bitrates. These anchor bitrates are starting values from which the bitrate can be decreased by reducing the fraction of frames that carry prediction parameters. In the table below the four anchor bitrates and the corresponding values of the frame duration, the number of samples in a frame and the numbers of sub-frames per frame is given.

| Bit rate (kbit/s) | Frame size (ms) | # samples per frame | # sub-frames/frame |
|---|---|---|---|
| 15.8 | 15 | 240 | 6 |
| 18.2 | 10 | 160 | 4 |
| 20.1 | 15 | 240 | 8 |
| 24.0 | 15 | 240 | 10 |

By reducing the number of frames in which LPC coefficients are present, the bitrate can be controlled in small steps. If the fraction of frames carrying LPC coefficients varies from 0.5 to 1, and the number of bits required to transmit the LPC coefficients for one frame is 66, the maximum obtainable bitrate reduction can be calculated. With a frame size of 10 ms, the bitrate for the LPC coefficients can vary from 3.3 kbit/s to 6.6 kbit/s. With a frame size of 15 ms, the bitrate for the LPC coefficients can vary from 2.2 kbit/s to 4.4 kbit/s. In the table below the maximum bitrate reduction and the minimum bitrate are given for the four anchor bitrates.

| Anchor bitrate (kbit/s) | Maximum bitrate reduction (kbit/s) | Minimum bitrate (kbit/s) |
|---|---|---|
| 15.8 | 2.2 | 13.6 |
| 18.2 | 3.3 | 14.9 |
| 20.1 | 2.2 | 17.9 |
| 24.0 | 2.2 | 21.8 |

Figure 3:
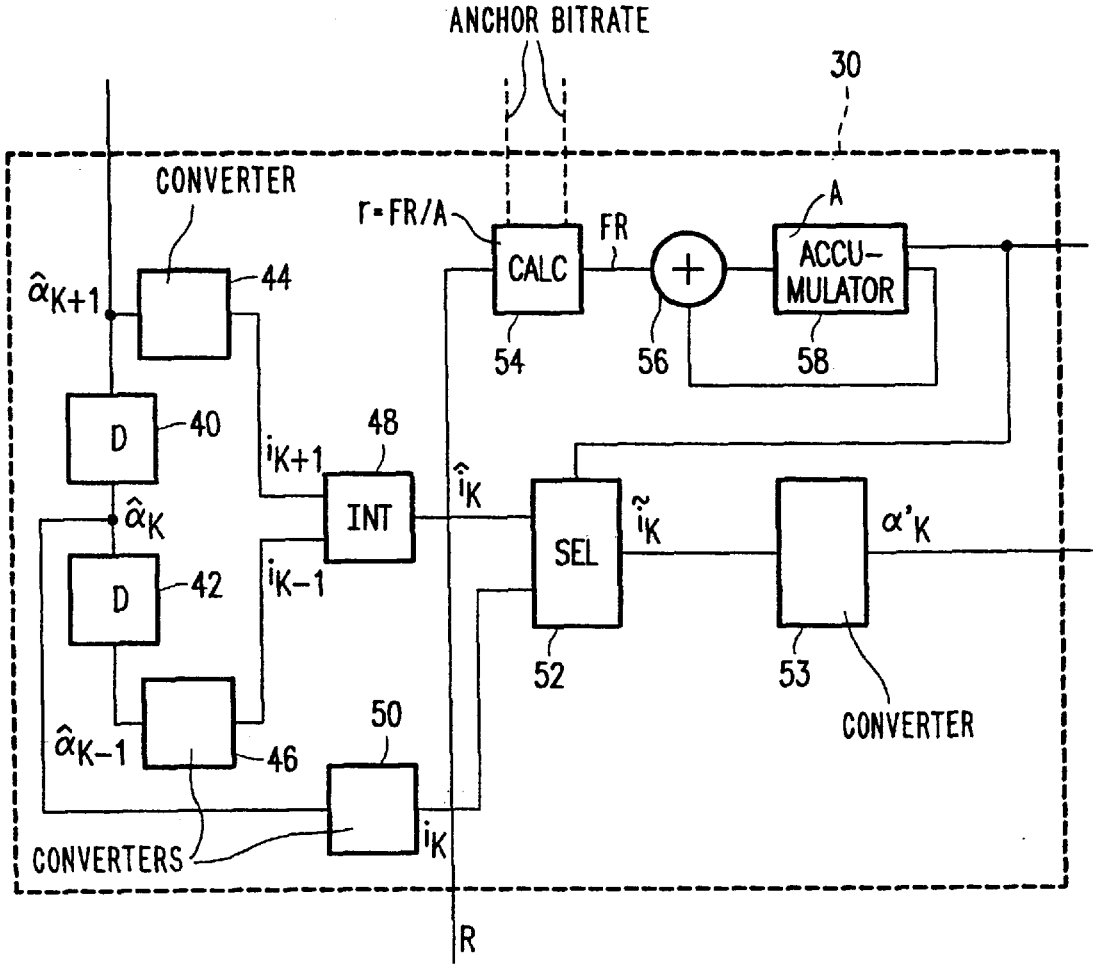
FIG. 3, a first embodiment of the bitrate controller 30 according to FIG. 2.

In the control means 30 according to FIG. 3, a first input carrying the signal $\hat{\alpha}_{k+1}$, is connected to an input of a delay element 40 and to an input of a converter 44. An output of the delay element 40, carrying the signal $\hat{\alpha}_k$, is connected to an input of a delay element 42 and to an input of a converter 50. An output of the delay element 42, carrying an output signal $\hat{\alpha}_{k+1}$, is connected to an input of a converter 46. An output of the converter 44, carrying an output signal $i_{k+1}$, is connected to a first input of an interpolator 48. An output of the converter 46, carrying an output signal $i_{k-1}$, is connected to a second input of the interpolator 48. The output of the interpolator 48, carrying an output signal $\hat{i}_k$, is connected to a first input of a selector 52. An output of the converter 50, carrying an output signal $i_k$, is connected to a second input of the selector 52. At the output of the selector 52, a signal $\tilde{i}_k$ is available. The output of the selector 52 is connected to an input of a converter 53. The output of the converter 53, carrying the signal $\alpha'_k$ to be used by the interpolator 32 in FIG. 2, is connected to the output of the control means 30.

A second input of the control means 30, carrying the signal R, is applied to calculating means 54. The output of the calculating means 54 is connected to an input of an adder 56. An output of the adder 56 is connected to an input of an accumulator 58. A first output of the accumulator 58, carrying the accumulated value, is connected to a second input of the adder 56. A second output of the accumulator 58, carrying an overflow signal, is connected to a control input of In the control means 30, the calculation means determine from the bitrate setting signal R the anchor bitrate, and the fraction of frames that carry LPC information. In case a certain bitrate R can be achieved starting from two different anchor bitrates, the anchor bitrate resulting in the best speech quality is chosen. It is convenient to store the value of the anchor bitrate as function as the signal R in a table. If the anchor bitrate has been chosen, the fraction of the frames carrying LPC coefficients can be determined.

First the values $B_{MAX}$ and $B_{MIN}$ representing the maximum value and the minimum value for the numbers of bits per frame are determined according to:

$$B_{MAX}=b_{HEADER}+b_{EXCITATION}+b_{LPC} \quad (1)$$

$$B_{MIN}=b_{HEADER}+b_{EXCITATION} \quad (2)$$

In (1) and (2) $b_{HEADER}$ is the number of header bits in a frame, $b_{EXCITATION}$ is the number of bits representing the excitation signal, and $b_{LPC}$ is the number of bits representing the analysis coefficients. If the signal R represents a requested bitrate $B_{REQ}$, for the fraction of frames r carrying LPC parameters can be written:

$$r = \frac{B_{\mathrm{REQ}} - B_{\mathrm{MIN}}}{B_{\mathrm{MAX}} - B_{\mathrm{MIN}}} \quad (3)$$

It is observed that in the present embodiment, the minimum value of r is 0.5.

A number FR representing the fraction of frames carrying LPC parameters, is applied to the adder 56. The adder 56 is arranged for adding every frame interval the number FR to the content of the accumulator 58. The number FR and the maximum content A of the accumulator 58 are chosen such that FR/A=r. Consequently, the accumulator will overflow for a fraction r of the frame intervals. By using an overflow signal of the accumulator 58 for controlling the multiplexer 6 in FIG. 2, it is obtained that a fraction r of the frames at the output of the multiplexer 6 carries LPC coefficients.

The delay elements 40 and 42 provide delayed sets of reflection coefficients $\hat{c}_k$ and $\hat{\alpha}_{k+1}$ from the set of reflection coefficients $\hat{\alpha}_{k+1}$. The converters 44, 50 and 46 calculate coefficients $i_{k-1}$ $i_K$ and $i_{K-1}$ being more suited for interpolation than the coefficients $\hat{\alpha}_{k+1}$, $\hat{\alpha}_k$ and $\hat{\alpha}_{k-1}$. Useful coefficients are Log Area Ratios, Arcsines of reflection coefficients, or Line Spectral Pairs. The interpolator 48 derives interpolated values $\hat{i}_k[n]$ from the values $i_{K+1}[n]$ and $i_{K-1}[n]$ according to the expression $(i_{K+1}[n]+i_{K-1}[n]\hat{\alpha}_{k+1})/2$. If the accumulator 58 overflows, LPC coefficients are transmitted, and the selector 52 will be arranged for passing the set of prediction coefficients $i_K$ to the converter 53. If no LPC coefficients are transmitted, the selector 52 will be arranged for passing the interpolated value $\hat{i}_k$ to the converter 53. The converter 53 converts the set of prediction coefficients $\tilde{i}_k$ into a set of prediction coefficients $\alpha'_K$, suitable for the filter 34. As explained before the local interpolation in the speech encoder 4 is performed in order to obtain for each sub-frame exactly the same prediction coefficients in the encoder 4 and the decoder 6.

Figure 4:
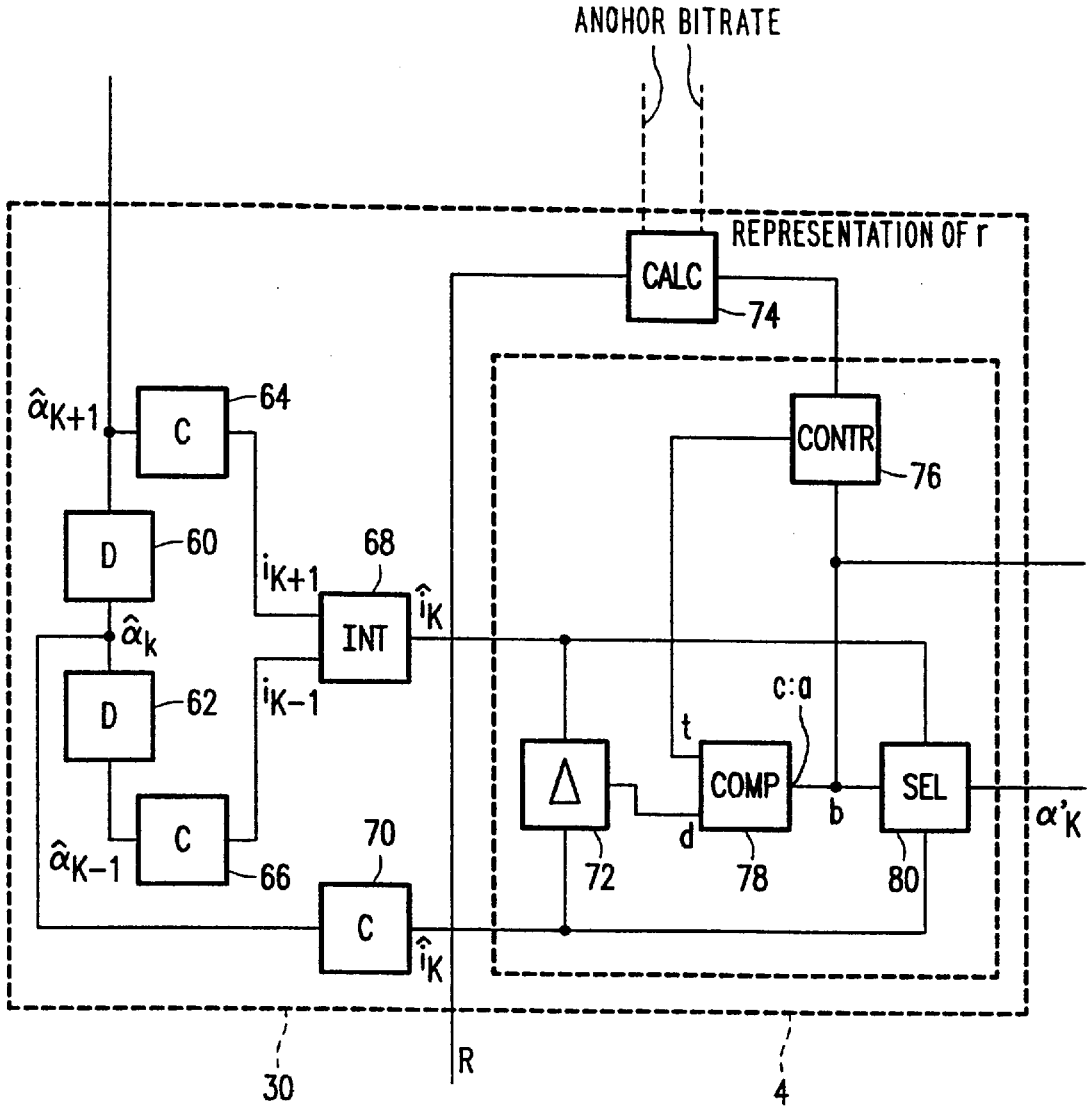
FIG. 4, a second embodiment of the bitrate controller 30 according to FIG. 2.

In the control means 30 according to FIG. 4, a first input carrying the signal $\hat{\alpha}_{k+1}$, is connected to an input of a delay element 60 and to an input of a converter 64. An output of the delay element 60, carrying the signal $\hat{\alpha}_k$, is connected to an input of a delay element 62 and to an input of a converter 70. An output of the converter 64, carrying an output signal $i_{k+1}$, is connected to a first input of an interpolator 68. An output of the converter 66, carrying an output signal $i_{k-1}$, is connected to a second input of the interpolator 68. The output of the interpolator 68, carrying an output signal $\hat{i}_k$, is connected to a first input a distance calculator 72 and to a first input of a selector 80. An output of the converter 70, carrying an output signal $i_k$, is connected to a second input of the distance calculator 72 and to a second input of the selector 80.

An input signal R of the control means 30 is connected to an input of calculation means 74. A first output of the calculation means 74 is connected to a control unit 76. The signal at the first output of the calculation means 74 represents the fraction r of the frames that carries LPC parameters. Consequently said signal is a signal representing the bitrate setting. A second and third output of the calculating means carry signals representing the anchor bitrate which are set in dependence on the signal R. An output of the control unit 76, carrying the threshold signal t, is connected to a first input of a comparator 78. An output of the distance calculator 72 is connected to a second input of the comparator 78. An output of the comparator 78 is connected to a control input of the selector 80, to an input of the control unit 76 and to an output of the control means 30.

In the control means according to FIG. 3 the delay elements 60 and 62 provide delayed sets of reflection coefficients $\hat{\alpha}_k$ and $\hat{\alpha}_{k-1}$ from the set of reflection coefficients $\hat{\alpha}_{k+1}$. The converters 64, 70 and 66 calculate coefficients $i_{K+1}$ $i_K$ and $i_{K-1}$ being more suited for interpolation than the coefficients $\hat{\alpha}_{k+1}$, $\hat{\alpha}_k$ and $\hat{\alpha}_{k-1}$. The interpolator 68 derives an interpolated value $\hat{i}_K$ from the values $i_{K+1}$ and $i_{K-1}$.

The distance calculator 72 determines a distance measure d between the set prediction parameters $i_K$ and the set of prediction parameters $\hat{i}_k$ interpolated from $i_{K+1}$ and $i_{K-1}$. A suitable distance measure d is given by:

$$d = \left[\frac{1}{2\pi}\int_0^{2\pi}\left(10\log H(\omega) - 10\log\hat{H}(\omega)\right)^2 d\omega\right]^{\frac{1}{2}} \quad (4)$$

In (4) $H(\omega)$ is the spectrum described by the coefficients $i_K$ and $\hat{H}(\omega)$ is the spectrum described by the coefficients $\hat{i}_k$. The measure d is commonly used, but experiments have shown that the more easy calculable L1 norm gives comparable results. For this L1 norm can be written:

$$d = \frac{1}{P}\sum_{n=1}^{P}\left|i_k[n] - \hat{i}_k[n]\right| \tag{5}$$

In (5), P is the number of prediction coefficients determined by the analysis means 22. The distance measure d is compared by the comparator 78 with the threshold t. If the distance d is larger than the threshold t, the output signal c of the comparator 78 indicates that the LPC coefficients of the current frame are to be transmitted. If the distance measure d is smaller than the threshold t, the output signal c of the comparator 78 indicates that the LPC coefficients of the current frame are not transmitted. By counting over a predetermined period of time (e.g. over k frames, k having a typical value of 100) the number of times a that the signal c indicated the transmission of the LPC coefficients, a measure a for the actual fraction of the frames comprising LPC parameters is obtained, briefly indicated by Cia. Given the parameters corresponding to the anchor bitrate chosen, this measure a is also a measure for the actual bitrate.

The control means 30 are arranged for comparing a measure for the actual bitrate with a measure for the bitrate setting, and for adjusting the actual bitrate if required. The calculation means 74 determines from the signal R, the anchor bitrate and the fraction r. The control unit 76 determines the difference between the fraction r and the actual fraction a of the frames which carry LPC parameters. In order to adjust the bitrate according to the difference between the bitrate setting and the actual bitrate the threshold t is increased or decreased. If the threshold t is increased the difference measure d will exceed said threshold for a smaller number of frames, and the actual bitrate will be decreased. If the threshold t is decreased, the difference measure d will exceed said threshold for a larger number of frames, and the actual bitrate will be increased. The update of the threshold t in dependence on the measure r for the bitrate setting and the measure b for the actual bitrate is performed by the control unit 76 according to:

$$t = \begin{cases} t' + c_1 \cdot |r - b| \text{ if } b \geq r \\ t' - c_2 \cdot |r - b| \text{ if } b < r \end{cases} \tag{6}$$

In (6) t' is the original value of the threshold, and $c_1$ and $c_2$ are constants.

Figure 5:
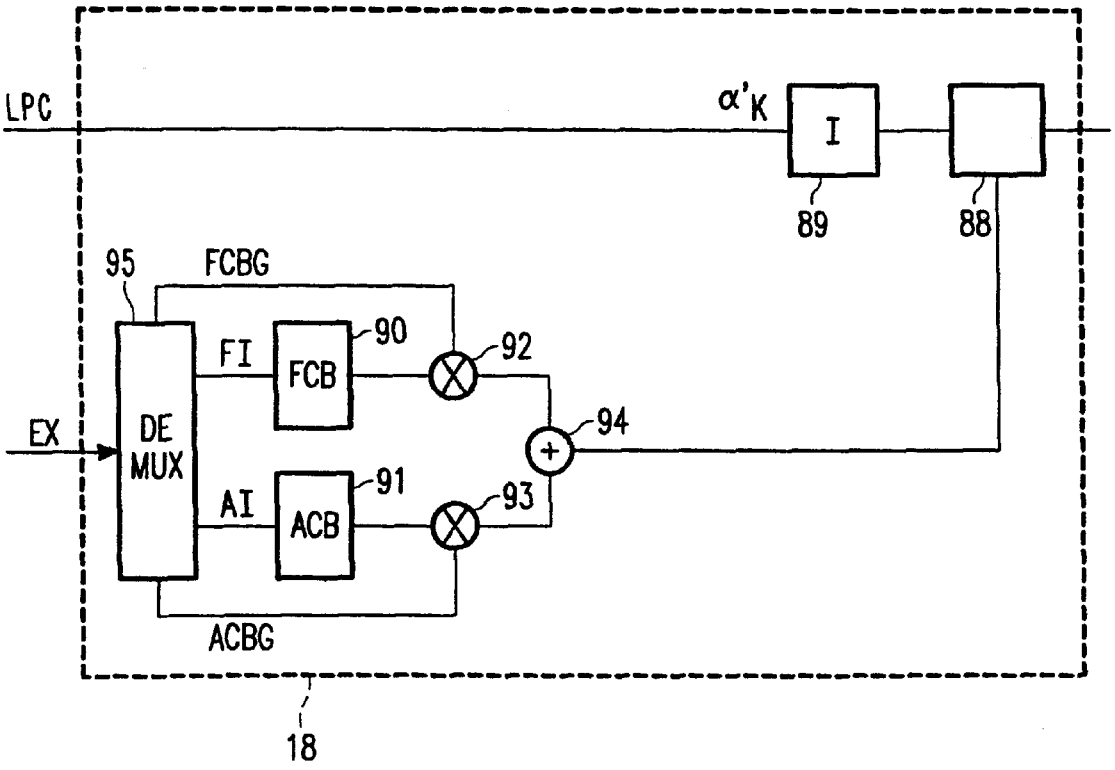
FIG. 5 an embodiment of the speech decoder 18 of FIG. 1.

In the decoding means 18 according to FIG. 5, an input carrying a signal LPC, is connected to an input of a sub-frame interpolator 89. The output of the sub-frame interpolator 87 is connected to an input of a synthesis filter 88.

An input of the speech decoding means 18, carrying input signal EX, is connected to an input of a demultiplexer 95. A first output of the demultiplexer 95, carrying a signal FI representing the fixed codebook index, connected to an input of a fixed codebook 90. An output of the fixed codebook 90 is connected to a first input of a multiplier 92. A second output of the demultiplexer, carrying a signal FCBG (Fixed CodeBook Gain) is connected to a second input of the multiplier 92.

A third output of the demultiplexer 95, carrying a signal AI representing the adaptive codebook index, is connected to an input of an adaptive codebook 91. An output of the adaptive codebook 91 is connected to a first input of a multiplier 93. A second output of the demultiplexer 95, carrying a signal ACBG (Adaptive CodeBook Gain) is connected to a second input of the multiplier 93. An output of the multiplier 92 is connected to a first input of an adder 94, and an output of the multiplier 93 is connected to a second input of the adder 94. The output of the adder 94 is connected to an input of the adaptive codebook, and to an input of the synthesis filter 88.

In the speech decoding means 18 according to FIG. 5 the sub-frame interpolator 89 provides interpolated prediction coefficients for each of the sub-frames, and passes these prediction coefficients to the synthesis filter 88.

The excitation signal for the synthesis filter is equal to a weighted sum of the output signals of the fixed codebook 90 and the adaptive codebook 91. The weighting is performed by the multipliers 92 and 93. The codebook indices FI and AI are extracted from the signal EX by the demultiplexer 95. The weighting factors FCBG (Fixed CodeBook Gain) and ACBG (Adaptive CodeBook Gain) are also extracted from the signal EX by the demultiplexer 95. The output signal of the adder 94 is shifted into the adaptive codebook in order to provide the adaptation.

Figure 6:
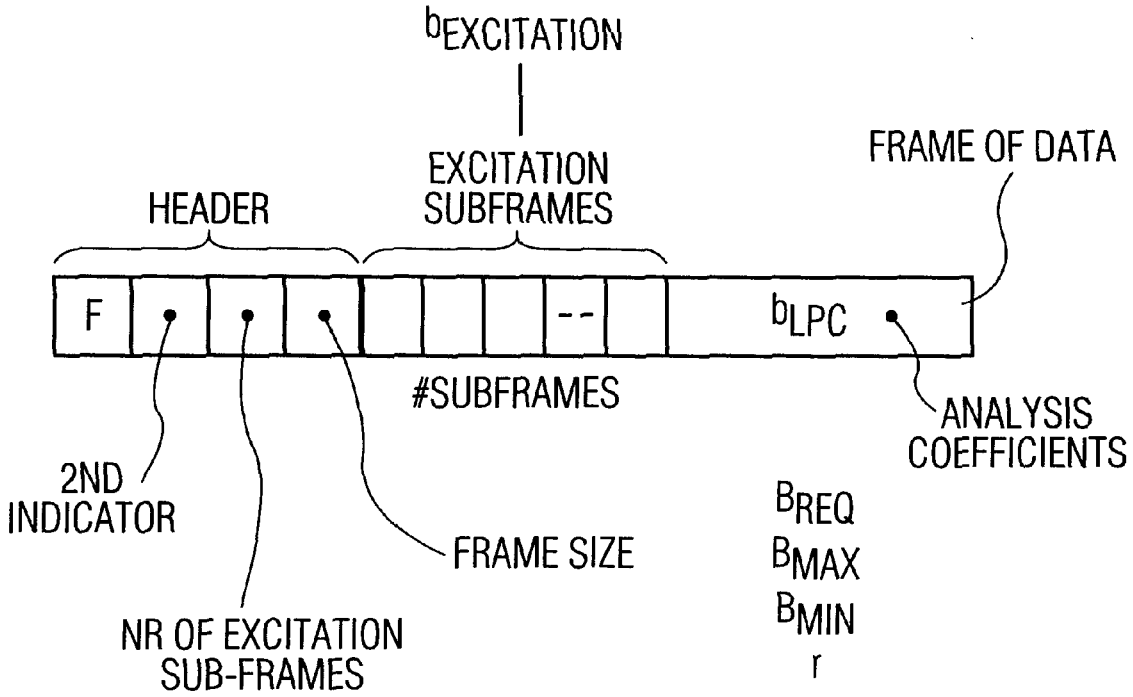
FIG. 6, a frame of data.

FIG. 6 shows a frame of data. The frame of data comprises a header with the first indicator F, the second indicator, the number of excitation sub-frames, and the frame size. The frame of data further comprises the number of bits $b_{EXCITATION}$, in excitation sub-frames, and, depending on the value of the first indicator F, the analysis coefficients $b_{LPC}$. Further indicated are the parameters $B_{REQ}$, $B_{MIN}$, $B_{MAX}$, and r that are associated with the frames of data and that have been described in relation with FIG. 3.

We claim:

1. Transmission system comprising:

a transmitter for transmitting frames of data representing a speech signal, said transmitter comprising a speech encoder, and the speech encoder comprising analysis means for determining analysis coefficients from the speech signal, calculation means for calculating from a bitrate setting a fraction of the frames of data to carry more information about said analysis coefficients than a remaining number of the frames of data, and control means for controlling the transmitter to transmit the fraction of the frames of data and the remaining number of the frames of data; and a receiver for receiving the frames of data through a transmission medium, the receiver comprising a speech decoder for deriving a reconstructed speech signal from the frames of data.

2. Transmission system according to claim 1, wherein the control means comprises comparing means for comparing a measure for an actual bitrate with a measure for the bitrate setting, the control means being arranged for increasing the actual fraction of the frames carrying more information about said analysis coefficients than the remaining frames if the measure for the actual bitrate is smaller than the measure for the bitrate setting, and for decreasing the actual fraction of the frames carrying more information about said analysis coefficients than the remaining frames, if the measure for the actual bitrate is larger than the measure for the bitrate setting.

3. Transmission system according to claim 2, wherein the control means are arranged for indicating the analysis parameters having a distance measure from values interpolated from analysis parameters transmitted in surrounding frames exceeding a threshold value, for decreasing the threshold if the measure for the actual bitrate is smaller than the measure for the bitrate setting, and for increasing the threshold if the actual measure for the bitrate is larger than the measure for the bitrate setting.

4. Transmission system according to claim 1, wherein the fraction of the frames carrying more information about said analysis coefficients than the remaining number of the frames is larger or equal to 0.5 and is smaller or equal to 1.

5. Transmission system according to claim 1, wherein the speech encoder is arranged for selecting in response to a coarse bitrate setting, one frame length out of a plurality of frame lengths and one number of excitation sub-frames per frame out of a plurality of excitation sub-frames per frame.

6. Transmission system according to claim 5, wherein the plurality of frame lengths comprise at least the values of 10 ms and 15 ms.

7. Transmission system according to claim 6, wherein the plurality of numbers of excitation sub-frames for a frame length of 10 ms comprises at least the value 4, and in that the plurality of number of excitation sub-frames for a frame length of 15 ms comprises at least the values 6, 8 and 10.

8. Transmitter for transmitting frames of data representing a speech signal, said transmitter comprising:

a speech encoder comprising analysis means for determining analysis coefficients from the speech signal, calculation means for calculating from a bitrate setting a fraction of the frames of data to carry more information about said analysis coefficients than a remaining number of the frames of data, and control means for controlling the transmitter to transmit the fraction of the frames of data and the remaining number of the frames of data.

9. Speech encoder comprising:

analysis means for determining analysis coefficients from a speech signal;

generation means for generating frames of data representing the speech signal;

calculation means for calculating from a bitrate setting a fraction of the frames of data to carry more information about said analysis coefficients than a remaining number of the frames of data; and control means for controlling a transmitter to transmit the fraction of the frames of data and the remaining number of the frames of data.

10. Speech encoding method comprising:

determining analysis coefficients from a speech signal;

generating frames of data representing the speech signal;

calculating from a bitrate setting a fraction of the frames of data to carry more information about said analysis coefficients than a remaining number of the frames of data; and controlling transmission of the fraction of the frames of data and the remaining number of the frames of data.

* * * * *